United States Patent [19]

Elliott

[11] 4,259,817

[45] Apr. 7, 1981

[54] INSULATIVE ROOF APPARATUS

[76] Inventor: Frank S. Elliott, 4815 N. 63rd Dr., Phoenix, Ariz. 85033

[21] Appl. No.: 9,162

[22] Filed: Feb. 5, 1979

[51] Int. Cl.[3] ..... E04B 7/00

[52] U.S. Cl. ..... 52/96; 52/58; 52/309.8; 52/404; 52/515; 52/809; 52/408

[58] Field of Search ..... 52/94, 96, 58, 309.8, 52/404, 408–411, 515, 809

[56] References Cited

U.S. PATENT DOCUMENTS

| | | | |
|---|---|---|---|
| 3,365,847 | 1/1968 | Josek | 52/94 |
| 3,483,664 | 12/1969 | Funk et al. | 52/96 |
| 3,585,766 | 6/1971 | Jamieson | 52/94 |
| 3,680,269 | 8/1972 | Fischer et al. | 52/94 |
| 3,729,884 | 5/1973 | Dunn | 52/94 X |
| 3,760,546 | 9/1973 | Martin et al. | 52/94 |
| 3,958,373 | 5/1976 | Stewart | 52/58 |
| 4,045,922 | 9/1977 | Elliott | 52/94 |
| 4,160,346 | 7/1979 | Kaufmann | 52/96 |

FOREIGN PATENT DOCUMENTS

| | | | |
|---|---|---|---|
| 2436086 | 2/1976 | Fed. Rep. of Germany | 52/309.8 |

*Primary Examiner*—J. Karl Bell

*Attorney, Agent, or Firm*—H. Gordon Shields

[57] ABSTRACT

Insulative roof apparatus includes flexible layers of different materials, including insulation and sealing materials, all of which are flexible, to withstand movement of the roof of mobile homes and similar buildings.

7 Claims, 4 Drawing Figures

INSULATIVE ROOF APPARATUS

BACKGROUND OF THE INVENTION

1. Field of the Invention:

This invention relates to roof apparatus and, more particularly, to flexible roof apparatus for use with structures in which movement may occur, such as mobile homes.

2. Description of the Prior Art:

U.S. Pat. No. 4,045,922, issued Sept. 6, 1977, the inventor-patentee of which is the applicant herein, discloses insulative roof apparatus for mobile homes in which the insulative apparatus includes flexible materials.

While flexible insulation material, such as "Fiberglass," has been known and used for many years, such insulative materials typically are disposed beneath a substantially inflexible roof and thus are not exposed to, or in juxtaposition against, a roof structure directly. Similarly, urethanes are sometimes used to seal flat, inflexible roofs of buildings. Such roofs are normally not subjected to movement which tends to cause cracks, or the like, in the roofs and in the cured urethanes. However, if movement or flexing of such roof occurs, cracks usually result, and the cracks lead to roof leakage. One of the problems with mobile homes is that the homes tend to be somewhat movable or flexible as an inherent trait. Such roofs are typically made simply of thin sheets of steel, or the like, with a relatively thin layer of insulation disposed beneath the outer sheet of steel roofing. As a result of the relatively thin amount of insulation, such mobile homes, and similar structures, tend to be relatively inefficient, energy-wise, in both allowing for the escape of heat in cold weather and allowing for the inflow of heat in hot weather.

A vapor barrier is a necessity in homes, whether they be mobile homes or permanent, fixed homes. Such vapor barrier prevents the condensation of moisture from being a problem beneath the vapor barrier. An example of a vapor barrier in conjunction with a roofing and insulation system is shown in U.S. Pat. No. 2,861,525, issued Nov. 25, 1958. An outer roof waterproofing is disposed on top of an insulative layer, and a vapor barrier is disposed beneath the insulation and adjacent a roof deck.

Another example of a vapor barrier and insulation disposed between an outer roof panel and the frame of a building is shown in U.S. Pat. No. 3,307,306, dated Mar. 7, 1967. In the '306 patent, a vapor barrier is disposed directly against roof framing, with the insulation above the vapor barrier and with roof panels disposed on top of the insulation. In this type of arrangement, moisture may condense within the insulation.

Due to the inherent construction of the roof and insulation apparatus of both the '525 and '306 patents, flexibility of a roof structure is not discussed and is not a problem. The roof apparatus of both patents, including the insulation, is designed for what may be referred to as inflexible or "solid" building structures, as opposed to "flexible" building structures, such as mobile homes.

Another problem inherent with the roof structures of flexible buildings is the sealing of the outer periphery or perimeter of the roofs. U.S. Pat. No. 3,404,495 discloses a flashing apparatus for the edge of a flat roof. The flashing system is for solid, and not flexible, roofs or roof structures. That is, the roof apparatus of the '495 patent is designed for a solid as opposed to a flexible building, and flexibility is not a concern in the '495 patent. In the '922 patent discussed above, the inventor discloses a flexible outer seal for sealing the insulative roof apparatus, in which the outer seal is a separate unit or entity from the insulative roof structure itself. In the apparatus of the present invention, the seal for the outer periphery is an integral part of the roof structure itself.

SUMMARY OF THE INVENTION

The apparatus disclosed and claimed herein comprises an insulative roof structure for a flexible roof which includes integral sealing elements for sealing the outer periphery of the roof.

Among the objects of the present invention are the following:

To provide new and useful insulative apparatus;

To provide new and useful insulative roof apparatus for flexible building structures;

To provide new and useful means for sealing roof structures;

To provide integral roof and seal elements;

To provide new and useful insulative roof apparatus with integral seals for the periphery of the roof; and To provide new and useful roof apparatus for mobile homes in which the roof apparatus is flexible and sealed directly to the base structure.

BRIEF DESCRIPTION OF THE DRAWING

FIG. 1 is a view in partial section of insulative roof apparatus 10 disposed on the roof of a flexible building structure 2 at the juncture of a ceiling or roof 4 and a wall 6. The roof or ceiling element 4 may be either a wooden roof or a metal roof, as desired. Typically, such roof element may be either, depending on a particular structure involved. The vertical wall element 6 is typically a wooden element, such as a 2×2, a 2×3, or a 2×4. The actual structural implementation of mobile homes and the like is well known and will not be discussed in detail herein. For purposes of the present invention, a vertical wall member and a roof or ceiling member are shown, at their juncture. Reference numeral 8 designates the corner or edge of the roof at the side of the structure. That is, as illustrated in FIGS. 1, 2, 3, and 4, the juncture of the vertical element 6 and the roof 4 is designated by reference numeral 8. Such juncture may also be referred to herein as the "corner" of the roof or "edge" of the roof, or similar terms.

Figure 1:
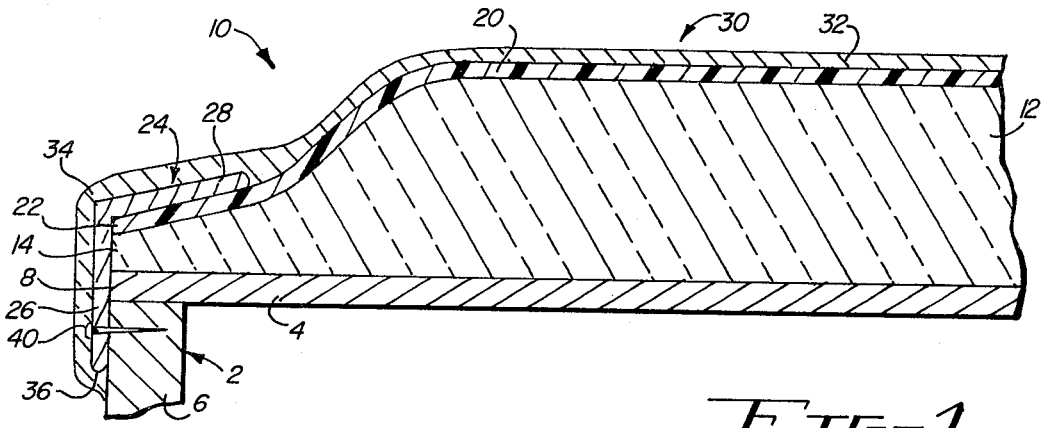
FIG. 1 is a view in partial section of an insulative roof apparatus disposed at the juncture of a ceiling or roof and a wall of a flexible building structure.

For purposes of the present invention, it will be understood that for the structure 2, the elements 4 and 6 comprise the outer peripheral members of a structure at the juncture of the roof and outer walls, and may include outer panels or outer walls as well as structural members. While the structural members, per se, of a building are not part of the present invention, the sealing of a roof apparatus to a structure's outer members, including structural members, to prevent leaking within the structure, is contemplated by the present apparatus.

A layer of insulation 12 is shown disposed on the roof 4. The insulation 12 may typically comprise a layer of insulative batt, or batting, such as "fiberglass" or the like. The fiberglass batts are disposed directly on top of the ceiling or roof 4. At the outer edge of the structure 2, defined by reference numeral 8 in FIG. 1, the insulation layer 12 terminates in its outer edge 14. Thus, the outer edge 14 of the insulation 12 is substantially coterminous with the edge 8 of the structure 2.

Disposed on top of the insulation layer 12 is a layer 20 of material impervious to moisture which comprises a vapor barrier. The impervious layer 20 includes an outer edge 22 which is in alignment with the outer edge 14 of the insulation 12, and accordingly it is aligned with the outer edge 8 of the structure 2. The vapor barrier layer 20 is disposed on top of the insulation 12 to prevent vapor from condensing beneath the barrier 20 and within the insulation layer 12. Any such condensation or moisture which collects in the insulation layer 12 substantially reduces the insulative properties and accordingly decreases the efficiency of the insulation. The vapor barrier 20 may be any material which is substantially impervious to moisture and which is flexible and somewhat elastic and accordingly will not tear or rip as the structure 2 moves in response to wind forces or to the bending and twisting forces incurred in transit, or the like. Moreover, the vapor barrier layer 20 is also flexible and elastic enough to withstand any walking which may be necessary by a repairman, servicing an accessory disposed on top of the structure 4. A sheet of vinyl, a rubberized cloth, or the like, may be used for such vapor barrier layer 20.

It will be understood that when referring to a "flexible" vapor barrier layer or sheet herein, the term "flexible" includes elastic properties that allow the material to stretch as required to prevent tearing, etc., under the stress to which it may be subjected.

For sealing the outer edge of the insulation, the vapor barrier layer, and the structure, a strip of flashing 24 is used. The flashing comprises a generally wide vee or obtuse ell shaped element including a vertical portion or arm 26 and an upwardly extending portion or arm 28. The vertical portion or arm 26 is shown extending upwardly from the upper portion of the element or structural member 6, to which it is secured by an appropriate fastening element, such as a nail 40. The vertical portion continues upwardly from the nail 40, above or past the juncture of the vertical element 6 with the roof 4, and above the outer edges 14 and 22 of the insulation 12 and vapor barrier 20, respectively. The upwardly extending portion or arm 28 is secured to the vertical portion 26 remote from the nail 40 and the lower end of the vertical portion 26, and extends on top of and is aligned with, the portion of the vapor barrier 20 inwardly from its outer edge 22. The arm 28 accordingly overlies the outer edge 22 of the vapor barrier and is disposed on the top thereof. As indicated in FIG. 1, the insulation layer 20 is somewhat reduced in vertical height at its outer edge 14 and inwardly therefrom, particularly beneath the arm 28 of the flashing 24. This provides a generally positive bias against the vapor barrier layer 20 and the flashing 28 to help hold the arm 28, the vapor barrier and the insulation together. That is, there is enough inherent springiness in the insulation 12 to provide a generally positive bias against the flashing 24 to help hold the flashing, the insulation, and the vapor barrier together, all around the outer periphery of the structure 2.

A seal coating 30, which may be of any appropriate material, is disposed on top of the vapor barrier 20 and over the flashing 24, extending downwardly along the flashing, and terminating below the flashing and against the outer portion of the vertical stud 6. The seal coating, as best shown in FIG. 1, may be considered as having three separate portions, which relate or correspond to the various elements of the roof apparatus 10. This includes a top portion 32 of the seal coating 30, a corner portion 34, which is disposed on the top of the flashing 24, and a lower edge 36 which extends beneath the vertical portion 26 of the flashing 24 to provide a seal directly against the outer surface of the structure 2. Thus, the seal coating 30 is disposed directly on top of the exposed portion of the vapor barrier 20, on top of the flashing 24, and beneath the flashing to completely enclose both the corner of the roof apparatus and the adjacent vertical portion of the wall of the structure as well as the exposed portion of the vapor barrier 20 inwardly with respect to the roof from the flashing 24.

The seal coating 30 is preferably made of a flexible material so that it will not crack or break upon either the pressure or weight of a repairman walking on the roof or in response to the movement or flexing of the structure 2, as discussed above under various circumstances. Moreover, the seal coating should be a material which resists ultra violet radiation and accordingly does not disintegrate or break down upon extended exposure to sunlight. Further, the seal coating is preferably white or light colored to reflect a maximum amount of radiant energy.

The seal coating includes two important functions, one of which is to protect the vapor barrier from ultra violet radiation. A second important function is to seal the entire roof apparatus, including the outer perimeter or periphery of the apparatus. A secondary function is to contribute insulation properties to the roof apparatus. Obviously, to be effective for insulation, the seal coating should comprise a layer of more than nominal thickness.

Figure 2:
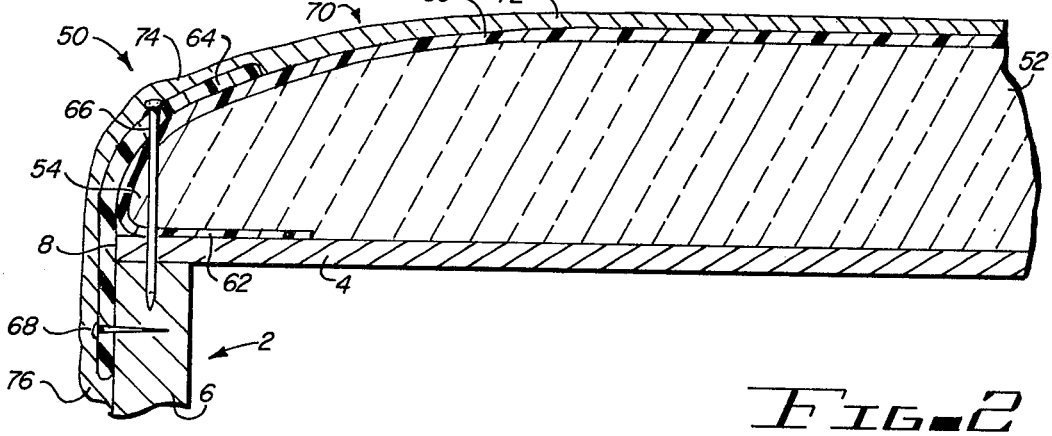
FIG. 2 is a similar view showing an alternate embodiment.

FIG. 2 is a view in partial section of an alternate embodiment of the roof apparatus 10 of FIG. 1. It comprises a view in partial section of roof apparatus 50 disposed on the roof of the flexible building structure 2 illustrated in FIG. 1.

A layer of insulation 52, which may be substantially the same type of insulative batts illustrated and discussed in conjunction with FIG. 1, is disposed directly on the roof 4 of the structure 2. The insulation 52 includes an outer edge 54 which is substantially coterminous with the outer edge 8 of the roof and structure, as discussed above. A vapor barrier layer 60, which again comprises a substantially impervious layer of flexible material, such as vinyl, or the like, as discussed above, is disposed over the insulation layer 52. However, instead of terminating at the edge 54 of the insulation 52, the vapor barrier 60 includes a returned edge portion 62 which extends about the outer edge 54 of the insulation 52, and is disposed beneath the outer edge and outer portion of the insulation layer 52 and thus directly on the outer portion of the roof 4. The outer edge 62 of the vapor barrier 60 is accordingly tucked under or beneath the outer edge 54 of the insulation layer 52 to help provide an additional seal for the roof apparatus 50.

A strip of flashing 64 is disposed over the outer edge or juncture of both the vertical element 6 of the structure 2 and the roof 4, and over the outer edge 54 of the insulation 52. The flashing 64 terminates inwardly from the outer edge 54 of the insulation 52 and on top of the outer portion of the vapor barrier 60. The flashing 64 is accordingly simply laid against the insulation and on top of the vapor barrier. The flashing 64 is held in place by appropriate fasteners, such as a pair of nails, including a vertically downwardly extending nail 66, and a horizontally inwardly extending nail 68. The downwardly extending nail 66 extends through the upper portion of the flashing 64, through the vapor barrier 60, through the outer edge of the insulation 54, and through the vapor barrier again, this time through the returned edge 62, and into and through the roof 4 and the vertical element 6 of the structure's wall. The nail 68 extends directly through the flashing 64 and into the vertical element or member 6.

Due to the presence of both the flashing 64 and the nail 66, the outer edge 54 of the insulation 52 and the outer portion of the vapor barrier layer 60 are somewhat rounded and reduced in vertical height, as shown in FIG. 2.

On top of the impervious vapor barrier layer 60 is a seal coating 70. The seal coating 70 may be substantially the same material as discussed above with respect to the seal coat or coating 30 of FIG. 1. For purposes of discussion herein, the seal coating 70 may also include three separate portions, a top portion 72, a corner portion 74, and a lower edge portion 76. The top portion 72 covers substantially the entire roof apparatus on top of the vapor barrier 60, while the corner portion 74 covers the flashing 64 and the nails 66 and 68. The lower edge 76 is disposed beneath the corner portion 74, and covers the lower portion or edge of the flashing 64 and is disposed against the outer portion of the wall or vertical member 6, to provide a direct seal covering the bottom of the flashing. Thus the seal coating 70 is disposed completely over and covering the various portions of the roof apparatus to effectively seal the entire roof apparatus from one side of the structure to the other side of the structure, and about the entire outer periphery of the roof apparatus.

Figure 3:
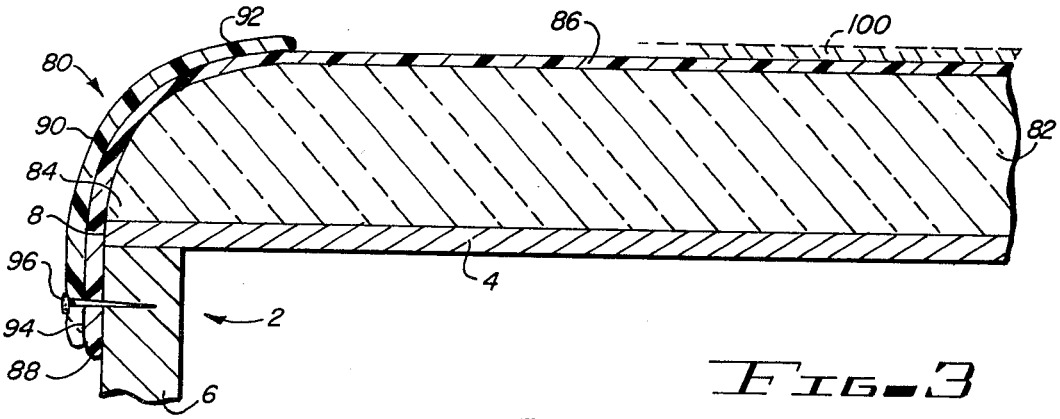
FIG. 3 is a similar view showing another alternate embodiment of the invention.

FIG. 3 comprises a view in partial section of an alternate embodiment of the apparatus of FIG. 2. The same building structure 2, with its respective horizontal roof or sealing elements 4 and its vertical elements 6, as discussed above in conjunction with FIGS. 1 and 2, is shown, particularly the portions at the juncture of the horizontal and vertical elements. However, a roof apparatus 80, which differs somewhat from both roof apparatus 50 of FIG. 2 and roof apparatus 10 of FIG. 1, is shown in FIG. 3 A layer of insulation 82 is shown disposed on the roof or ceiling element 4, and the insulation layer 82 terminates in an outer edge 84 adjacent the outer edge 8 of the building structure 2. The insulation 82 may be substantially the same as the insulations 12 and 52, discussed above in conjunction with FIGS. 1 and 2. It is preferably a layer of insulative batts or batting, such as "fiberglass".

A vapor barrier layer 86 of substantially water impervious and flexible sheeting material is shown disposed on top of the insulation 82, and an outer portion 88 of the vapor barrier 86 extends downwardly over the outer edge 84 of the insulation, and it terminates in a lower edge 88 below the juncture of the horizontal and vertical element of the structure 2. The alternate roof embodiment 80 includes a flashing corner strip 90 disposed over the outer edge 84 of the insulation 82, and over the edge of the vapor barrier 86. The flashing 90 is held in place against the structure 2 by an appropriate fastening element, such as a nail 96. The nail 96 is shown extending horizontally through a lower portion 94 of the flashing 90, the lower edge 88 of the vapor barrier 86, and into the vertical element 6 of the structure 2. An upper portion 92 of the flashing 90 extends over the outer corner or edge 84 of the insulation 82 and it, together with the outer corner of the vapor barrier 86, results in the rounded corner of the roofing apparatus 80, as shown in FIG. 3.

If the vapor barrier material is sufficiently strong and is resistant to ultra violet radiation damage, no seal coat may be required. Since the lower portion 88 of the vapor barrier 86 extends downwardly beyond the corner 8 of the roof and the wall, the corner is protected against the intrusion of moisture. Moreover, the flashing may alone provide sufficient outer peripheral securement for the roof apparatus. The horizontal nailing of the flashing 90 and the vapor barrier 86 at its lower portion 88 obviates moisture penetration downwardly through any nail hole. However, the joint or juncture of the vapor barrier 86 and the outer edge of the upper portion 92 of the flashing 90 may require caulking (not shown).

Figure 4:
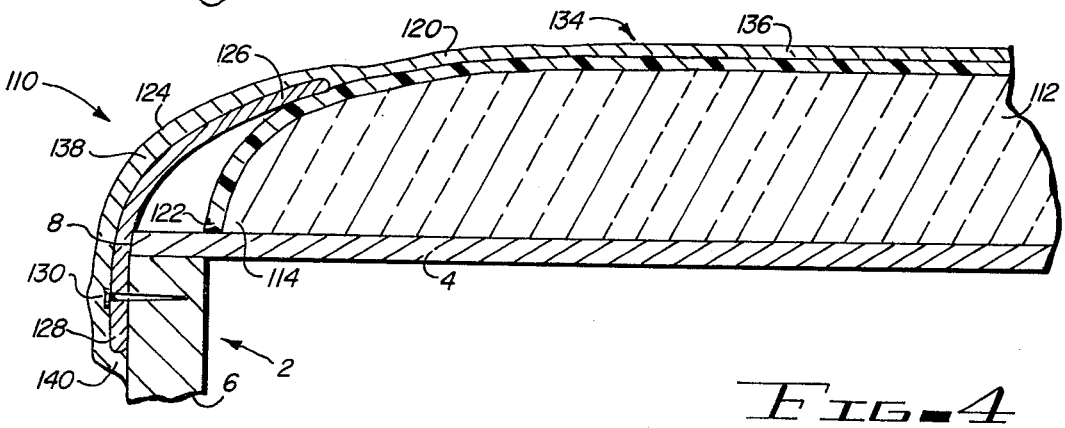
FIG. 4 is a similar view showing yet another alternate embodiment of the invention.

FIG. 4 comprises an alternate embodiment of the apparatus of FIGS. 1–3. It comprises a view in partial section of roof apparatus 110 disposed on a building or structure 2, showing the construction of the roof apparatus 110 at the outer juncture 8 of a horizontal roof element 4 and a vertical structural element or wall element of the building 2.

An insulation layer 112 is shown disposed on the horizontal element 4 of the structure 2. The insulation 112 preferably comprises a layer of insulative batts, as discussed above in conjunction with FIGS. 1, 2, and 3. At the outer portion or juncture of the structure 2, the insulation 112 terminates in an edge 114 which is just inside the outer periphery of the building or structure 2. The outer edge 114 is accordingly of a slightly different configuration from the outer edge portions 14, 54, and 84, of FIGS. 1, 2, and 3, respectively.

A vapor barrier 120, which comprises an impervious layer of vinyl, rubber, rubberized cloth, or the like, as discussed above, and which is both flexible and substantially impervious to moisture, is disposed on top of the insulation 112. The vapor barrier 120 terminates in an outer edge 122 which is generally coextensive with the outer edge 114 of the insulation 112. It thus overlies the outer edge 114 of the insulation 112, and terminates on top of the roof element 4. To hold the outer edges 114 and 112 of the insulation 112 and vapor barrier 120, respectively, in place, there is employed a strip of flashing 124, which includes an upper portion 126 and a lower portion 128. The upper portion 126 extends upwardly and over the vapor barrier 120, while the lower portion 128 extends generally downwardly beyond the corner 8 of the roof 4 and the wall 6. The flashing 124 is thus generally disposed on top or above the outer edge 122 of the vapor barrier 120 and over the outer edge 114 of the insulation 112. An appropriate fastening element, such as a nail 130, is shown extending through the lower portion 128 of the flashing 124, and into the side or vertical member 6. The flashing 124 thus provides a smooth transition between the insulation 112 and its vapor barrier 120 and the side 6 of the structure 2.

A seal coating 134, like the seal coatings discussed above in conjunction with FIGS. 1 and 2, covers the entire vapor barrier 120 and the flashing strip 124. The seal coating 134 includes a top portion 136, a corner portion 138, and a lower edge 140. The lower edge 140 terminates against the vertical side 6 of the structure 2, while the corner portion 138 extends over the flashing 124 between the lower edge 140 and the top portion 136.

With respect to the seal coatings discussed above in conjunction with FIGS. 1, 2, and 4, there are several different types of chemical compounds which may be used in the apparatus of the present invention. They may accordingly be sprayed on, rolled on, or applied by any method or apparatus appropriate to the particular type of chemical composition used. Preferably, several layers are used to provide the requisite strength and depth necessary. In most cases, the seal coating performs a dual function, including a function of contributing to the overall insulation of the roof apparatus as well as the function of sealing the apparatus to make it impervious to rain, dust, and the like, and sealing out harmful ultra violet rays.

Referring again to FIG. 3, the apparatus 80 has been discussed above as not including a seal coat. However, it is obvious that, if desired, a seal coat, such as indicated in phantom in FIG. 3, and identified by reference numeral 100, may be added.

The layers of insulation discussed above in connection with FIGS. 1–4 have been described as batts of fiberglass insulation. The term "batt" as used herein is meant to include the term "blanket", "sheet", or any other term used in the insulation trade to refer to the various types of flexible insulation which may be used to cover a roof. In addition to fiberglass, which is widely used as a flexible and relatively efficient insulation, other types of insulation may also be used, such as various foams, mineral insulations, or high temperature insulations.

What is claimed is:

1. Flexible insulation apparatus for a building structure having a roof and walls, comprising, in combination:

flexible insulation means disposed on the roof and terminating adjacent the juncture of the roof and the walls;

vapor barrier means, comprising a layer of flexible material impervious to moisture disposed on the flexible insulation means;

flexible seal coating means of more than nominal thickness disposed on the vapor barrier means for protecting the vapor barrier means and for sealing the flexible insulation means and the vapor barrier means and for providing additional insulation for the apparatus;

flashing means secured to the walls of the structure for securing the flexible insulation means and the vapor barrier means to the walls and to the roof.

2. The apparatus of claim 1 in which the insulation means includes an edge portion and the vapor barrier means includes a returned edge portion disposed beneath the edge portion of the insulation means.

3. The apparatus of claim 1 in which the flashing means includes an upper portion disposed over the vapor barrier means and a lower portion disposed against a wall below the juncture of the roof and the wall, and the seal coating means includes a top portion over the vapor barrier means, a corner portion over the flashing means, and a lower portion secured to the wall below the lower portion of the flashing means.

4. On a structure having walls and a roof joining the walls, flexible insulation apparatus disposed on the roof, comprising, in combination:

a layer of flexible insulation disposed on the roof;

an edge portion of the insulation disposed adjacent a wall;

vapor barrier means, comprising a flexible layer disposed on the layer of insulation and including an outer edge portion disposed on the edge portion of the insulation;

flexible seal means disposed on the vapor barrier means;

flashing means secured to the vapor barrier means, to the seal means, and to the structure for securing the vapor barrier means and the insulation means to the structure.

5. The apparatus of claim 4 in which the flashing means includes an upper portion disposed over the end portion of the vapor barrier means and a lower portion secured to the wall.

6. The apparatus of claim 5 in which the vapor barrier means extends to and is secured to the wall.

7. The apparatus of claim 6 in which the vapor barrier means includes a first layer of impervious material disposed on the insulation and a second layer of seal coating disposed on the first layer of impervious material for protecting the first layer and for sealing the insulation and the first layer of impervious material.

* * * * *